US010471504B2

(12) United States Patent
Imahase et al.

(10) Patent No.: US 10,471,504 B2
(45) Date of Patent: Nov. 12, 2019

(54) SLIDE METAL FRAME-DRIVE UNIT COUPLING POSITION SWITCHING MECHANISM FOR A SLIDING NOZZLE APPARATUS

(71) Applicant: KROSAKIHARIMA CORPORATION, Fukuoka (JP)

(72) Inventors: Toshihiro Imahase, Fukuoka (JP); Junichi Funato, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 166 days.

(21) Appl. No.: 15/548,563

(22) PCT Filed: Dec. 10, 2015

(86) PCT No.: PCT/JP2015/084671
§ 371 (c)(1),
(2) Date: Aug. 3, 2017

(87) PCT Pub. No.: WO2016/136092
PCT Pub. Date: Sep. 1, 2016

(65) Prior Publication Data

US 2018/0001379 A1 Jan. 4, 2018

(30) Foreign Application Priority Data

Feb. 27, 2015 (JP) ..... 2015-038868

(51) Int. Cl.
*B22D 41/38* (2006.01)
*B22D 11/10* (2006.01)

(52) U.S. Cl.
CPC ..... *B22D 41/38* (2013.01); *B22D 11/10* (2013.01); *Y10T 137/5109* (2015.04)

(58) Field of Classification Search
CPC .... B22D 41/38; B22D 11/10; Y10T 137/5109
(Continued)

(56) References Cited

U.S. PATENT DOCUMENTS 6,273,125 B1 * 8/2001 Blenkush ..... F16K 35/06 137/111
6,398,184 B1 * 6/2002 Sowada ..... F16K 35/00 251/284

(Continued)

FOREIGN PATENT DOCUMENTS

CN 105102155 A 11/2015
EP 2979777 A1 2/2016

(Continued)

OTHER PUBLICATIONS

Merriam-Webster,"Thesaurus", accessed Mar. 15, 2019,Synonyms and Antonyms of RECESS, https://www.merriam-webster.com/thesaurus/recess (Year: 2019).*

(Continued)

*Primary Examiner* — Jessica Cahill
*Assistant Examiner* — Patrick C Williams
(74) *Attorney, Agent, or Firm* — Paul D. Bianco; Fleit Gibbons Gutman Bongini & Bianco PL

(57) ABSTRACT

A simplified and downsized coupling position switching mechanism capable of transmitting reliably and smoothly the driving force of the drive unit to the slide metal frame to switchably change a coupling position between the slide metal frame and the drive unit in the sliding nozzle apparatus. A coupling portion in the slide metal frame protrudes on the side of the drive unit and allows a rod head of the drive unit to be coupled thereto, and the coupling portion has a coupling space allows the rod head to be disposed movably in a sliding direction of the slide metal frame. A separator is inserted into the coupling space to divide the coupling space into first and second coupling chambers in the sliding direction of the slide metal frame. The coupling portion has a fitting section for allowing the separator to be fitted thereinto when it is inserted into the coupling space.

6 Claims, 17 Drawing Sheets

(58) Field of Classification Search
USPC ..... 137/269; 251/279, 280, 89, 90, 326
See application file for complete search history.

(56) References Cited

U.S. PATENT DOCUMENTS

| | | | | |
|---|---|---|---|---|
| 7,690,624 | B2 * | 4/2010 | Ito | F16B 39/16<br>251/129.12 |
| 2007/0029709 | A1 * | 2/2007 | Keller | B22D 41/38<br>266/271 |
| 2011/0253337 | A1 * | 10/2011 | Matsui | B22D 11/10<br>164/459 |
| 2015/0076385 | A1 * | 3/2015 | Yamamoto | B22D 41/38<br>251/326 |
| 2016/0045956 | A1 | 2/2016 | Funato et al. | |

FOREIGN PATENT DOCUMENTS

| | | | |
|---|---|---|---|
| JP | 53-53526 | | 5/1978 |
| JP | 5283772 | | 6/2013 |
| JP | 2014208380 | A | 11/2014 |
| WO | 2014157157 | A1 | 10/2014 |

OTHER PUBLICATIONS

International Preliminary Report on Patentability dated Aug. 29, 2017 for PCT/JP2015/84671 filed Dec. 10, 2015.
Written Opinion for PCT/JP2015/84671 filed Dec. 10, 2015.
International Search Report for PCT/JP2015/84671 filed Dec. 10, 2015.

* cited by examiner a second embodiment (PRIOR ART)

(a second embodiment)

(a second embodiment)

(PRIOR ART)

SLIDE METAL FRAME-DRIVE UNIT COUPLING POSITION SWITCHING MECHANISM FOR A SLIDING NOZZLE APPARATUS

TECHNICAL FIELD

The present invention relates to a mechanism for switchably changing a coupling position between a slide metal frame and a drive unit in a sliding nozzle apparatus for controlling a flow rate of molten metal.

BACKGROUND ART

A sliding nozzle apparatus is configured such that one of two or three refractory plates having a nozzle hole is slidingly moved while they are clamped at a high pressure (while they are applied with a surface pressure therebetween), to thereby change a degree of opening of the nozzle hole to control a flow rate of molten metal. This slidingly-movable plate (i.e., sliding plate) is held by a slide metal frame, which is provided in an openable and closable manner so as to enable the sliding plate to be replaced with a new one.

The sliding plate reaches its usable life after it is used only several times. Thus, there is a need to replace the sliding plate with a new one or check a damage state of the sliding plate, by opening the slide metal frame. In this case, it is necessary to release the surface pressure before opening the slide metal frame, and then apply the surface pressure again after closing the slide metal frame.

As a way to apply and release the surface pressure in the sliding nozzle apparatus, there has been known a technique of applying and releasing the surface pressure by means of sliding movement (sliding displacement) of the slide metal frame. That is, this technique is configured to cause a spring to be deformed by using a driving force during sliding movement of the slide metal frame. In this technique, a slide range (movable range) of the slide metal frame during an operation of applying or releasing the surface pressure is set to go beyond a slide range during a casting operation. For this reason, in case of using two types of drive units having different strokes between during the casting operation and during the surface pressure applying/releasing operation, there is a problem of increased cost due to requiring two drive units.

On the other hand, there has also been proposed another technique of switchably changing the coupling position between the drive unit and the slide metal frame, by using one drive unit.

For example, the following Patent Document 1 discloses a coupling position switching technique configured to couple a drive unit and a slide casing (slide metal frame) through a guide piece, and switchably change a coupling position between the drive unit and the guide piece within an opening defined in the guide piece, by using a coupling position switching means. This guide piece is configured to be moved linearly based on a guide rail provided on a base frame, and an extension guide disposed to be slidingly moved along the guide rail in an extendable manner.

More specifically, in the second embodiment of Patent Document 1, as depicted in FIG. 16, the coupling position switching means 20 is a rectangular shaped bar as whole as viewed in a plane, and is provided with a semi-cylindrical recess 20*a* and a handle 20*b*. At both ends of the recess 20*a*, a first and second counterbore portions 20*a*A, 20*a*B are formed, which have diameters greater than that of recess

20*a*. The counterbore portions 20*a*A, 20*a*B are configured such that the protruding portion 7*e* located at the distal end of the rod 7A as described herein below is engaged inside the counterbore portions.

In first coupling position as depicted in FIG. 17, this coupling position switching means 20 is arranged between the coupling member 7*a* of the drive unit 7 and a first positioning surface a of the opening 25, in the second coupling position (not depicted), the coupling switching means 20 is arranged between the protruding portion 7*e* of the coupling member 7*a* and a second positioning surface b. In addition, as depicted in FIG. 18, it is described that the connecting switching means 20 is moved up and down in the direction of arrows A and D and the rod 7A is moved in the direction of arrow B or E so that the position of such coupling position switching means 20 is changed.

However, according to the technique disclosed in Patent Document 1, the driving force caused by forward and backward movements of the rod 7A is adapted to be transmitted to the slide casing 4 via the coupling position switching means 20 and the guide piece 24, in this case, the coupling position switching means 20 is merely brought into contact with the guide piece 24. As such, there is a problem in the reliability and smoothness of transmission of the driving force to the slide casing 4 according to the forward and backward movement of the rod 7A.

Furthermore, the coupling position switching means 20 is a spacer as an extension means of the rod 7A which is inserted between the front face of the head of the rod 7A and the inner wall face of the space or between the rear face of the head of the rod 7A and the space. As such, this coupling position switching means 20 requires to put it in two positions (a first coupling position and a second coupling position) during the surface pressure applying/releasing operation and during the casting operation (during use), so the operation becomes complicated, and the coupling position switching means is likely to be inserted in the wrong position. Moreover, due to a different arrangement position of the coupling position switching means 20 between the first coupling position and the second coupling position, it is not possible to hold the coupling position switching means 20 to the guide piece, and it is necessary to remove the coupling position switching means 20. As a result, the operation becomes complicated, and there is also a problem that the coupling position switching means 20 is easy to be lost.

Further, in Patent Document 1, the rod 7A and the slide casing 4 are connected via the guide piece 24. The guide piece 24 is configured to be moved linearly based on a guide rail provided on a base frame, and an extension guide disposed to be slidingly moved along the guide rail in an extendable manner. Therefore, the connecting structure via the guide piece 24 becomes complicated and increases in size. In addition, the guide piece 24 increases in size due to having a detachable portion with respect to the slide casing 4.

CITATION LIST

Patent Document

Patent Document 1: JP 5283772B

SUMMARY OF INVENTION

Technical Problem

A technical problem addressed by the invention is to provide a simplified and downsized coupling position switching mechanism capable of transmitting reliably and smoothly the driving force of the drive unit to the slide metal frame to switchably change a coupling position between the slide metal frame and the drive unit in the sliding nozzle apparatus.

Solution to Technical Problem

According to one aspect of the present invention, there is provided a slide metal frame-drive unit coupling position switching mechanism for use in a sliding nozzle apparatus configured such that a slide metal frame is slidingly moved by driving of a drive unit, to thereby apply and release a surface pressure in the sliding nozzle apparatus. The slide metal frame-drive unit coupling position switching mechanism comprises a coupling portion provided in the slide metal frame to protrude at a position on the side of the drive unit and configured to allow a rod head of a drive rod of the drive unit to be coupled thereto, and the coupling portion has a coupling space defined to allow the rod head to be disposed movably in a sliding direction of the slide metal frame and detachably. The slide metal frame-drive unit coupling position switching mechanism further comprises a separator configured to be inserted into the coupling space to thereby divide the coupling space into a first coupling chamber and a second coupling chamber in the sliding direction of the slide metal frame. The coupling portion has a fitting section for allowing the separator to be fitted thereinto when it is inserted into the coupling space. And the slide metal frame-drive unit coupling position switching mechanism is configured such that a first coupling state in which the rod head is coupled in the first coupling chamber and a second coupling state in which the rod head is coupled in the second coupling chamber are switched according to insertion and pull-out of the separator with respect to the coupling space and movement of the rod head.

Effect of Invention

In the coupling position switching mechanism of the present invention, the separator has a fitting relationship with the coupling portion during inserting the separator into the coupling space, such that the first coupling chamber and the second coupling chamber capable of inserting the rod head are always formed. As a result, the coupling position switching mechanism of the present invention can be simplified and reduced in size. The separator can be held by the coupling portion or the slide metal frame. For this reason, the operation becomes simplified, and there is free of concern of losing the separator.

Furthermore, the separator has a fitting relationship with the coupling portion, thereby the driving force of the drive unit can be transmitted at a plurality of arbitrary points. Thus the driving force of the drive unit can be distributed and transmitted to the coupling portion of the slide metal frame in a well-balanced manner. Therefore, it is possible to reliably and smoothly transmit the driving force of the drive unit to the slide metal frame.

DESCRIPTION OF EMBODIMENTS

Embodiments of the present invention will be described below based on examples depicted in drawings.

A First Example

Figure 1:
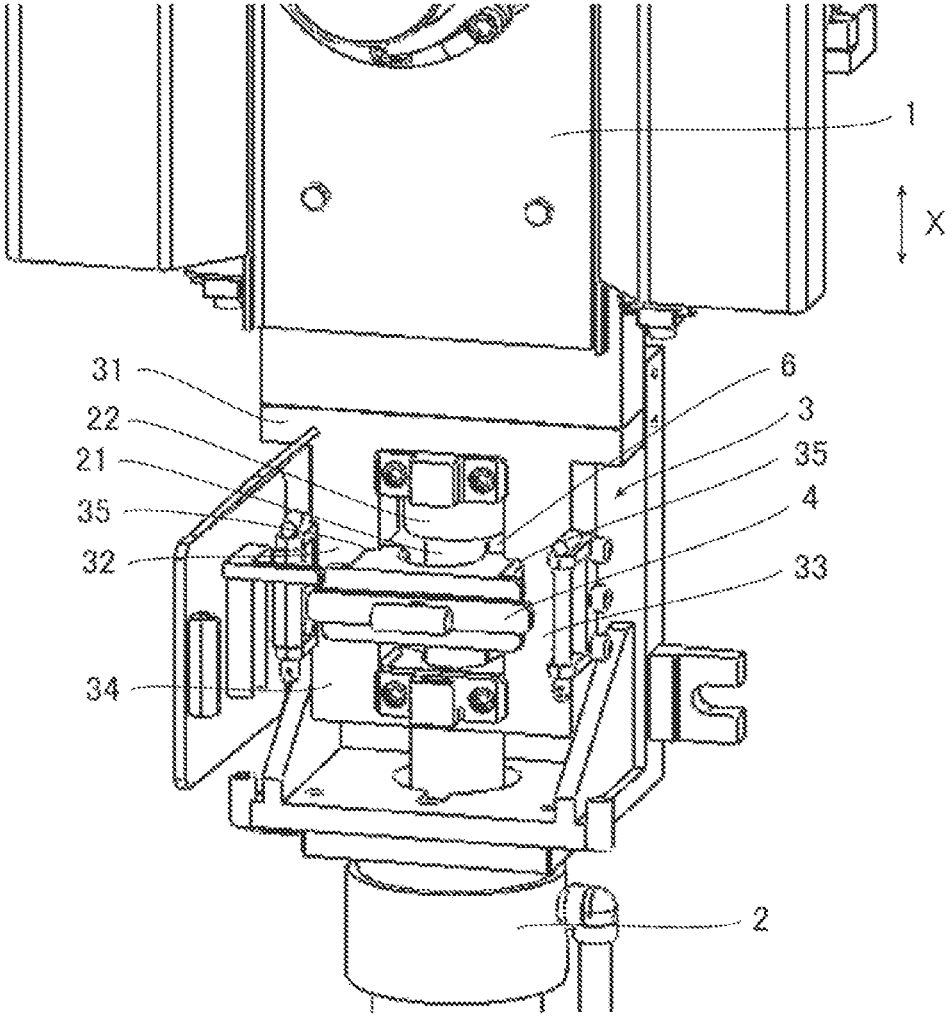
FIG. 1 is a perspective view depicting a slide metal frame-drive unit coupling position switching mechanism for a sliding nozzle apparatus, according to one example (a first example) of the present invention.
Figure 2:
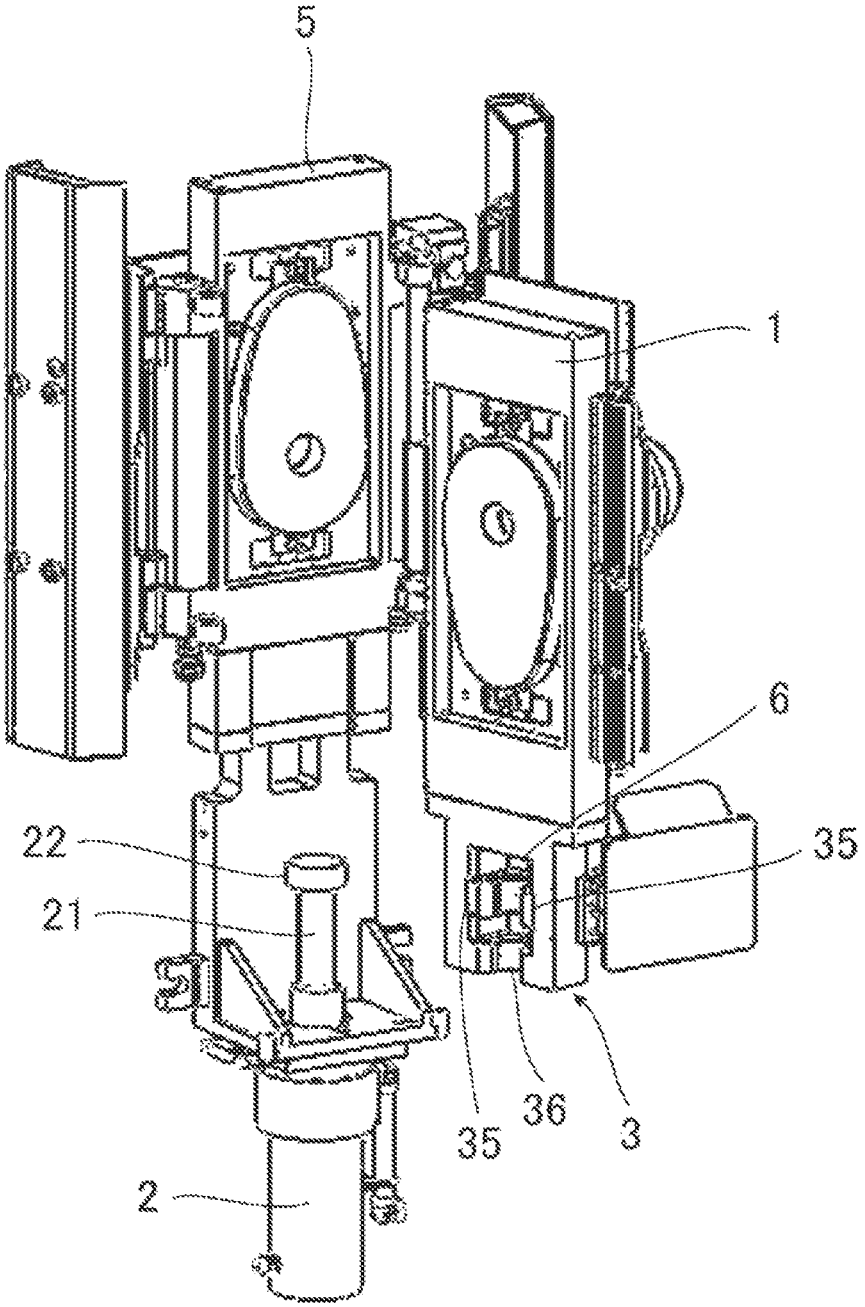
FIG. 2 is a perspective view depicting a sliding nozzle apparatus to which the coupling position switching mechanism of FIG. 1 has been applied.

FIG. 1 is a perspective view depicting a slide metal frame-drive unit coupling position switching mechanism for a sliding nozzle apparatus, according to one example of the present invention, while FIG. 2 is a perspective view depicting a sliding nozzle apparatus to which a slide metal frame-drive unit coupling position switching mechanism of FIG. 1 has been applied. The aforementioned plate-checking/replacing operation is performed in a state in which a slide metal frame 1 in a sliding nozzle apparatus is disposed to stand vertically. Accordingly, FIGS. 1 and 2 also depict the slide metal frame 1 in a vertically standing state.

As depicted in FIGS. 1 and 2, a slide metal frame-drive unit coupling position switching mechanism for a sliding nozzle apparatus comprises a coupling portion 3 provided in the slide metal frame 1, a drive rod 21 of a drive unit 2 which is disposed in a coupling space 6 of the coupling portion 3 so as to be capable of moving forwardly and backwardly in the sliding direction of the slide metal frame 1, and a separator 4 to be inserted into the coupling space 6. The drive unit 2 is held by a fixed metal frame 5 in the sliding nozzle apparatus.

The coupling portion 3 is provided to protrude the slide metal frame 1 toward the side of the drive unit 2, and is held by the slide metal frame 1. Specifically, the coupling portion 3 comprises a base end frame 31 connected to a side surface of the slide metal frame 1 on the side of the drive unit 2, two parallel frames 32, 33 extending in parallel from the base end frame 31 in the sliding direction X of the slide metal frame 1, and a coupling frame 34 connecting the two parallel frames 32, 33 to each other, and has the through-hole shaped coupling space 6 inside thereof. That is, the coupling space 6 is surrounded by the base end frame 31, two parallel frames 32, 33 and the coupling frame 34, and has a rectangular shape in a planar view. The base end frame 31 can be shared with the slide metal frame 1.

A rod groove 36 is provided in the coupling frame 34 on the side of the drive unit 2 and on the side of the fixed metal frame 5, into which the drive rod 21 of the drive unit 2 is movably fitted in the sliding direction X. The drive rod 21 is attachable and detachable to the coupling portion 3 through the rod groove 36.

In addition, the coupling portion 3 has fitting recesses 35 on the side of the coupling space 6 in two parallel frames 32, 33. The fitting recesses 35 are arranged symmetrically with respect to a longitudinal central axis of the drive rod 21.

In this case, the coupling portion 3 is held by the slide metal frame 1 as described above, therefore is neither brought into contact with the fixed metal frame 5 nor guided by the fixed metal frame 5 during the course of sliding of the slide metal frame 1.

Figure 3:
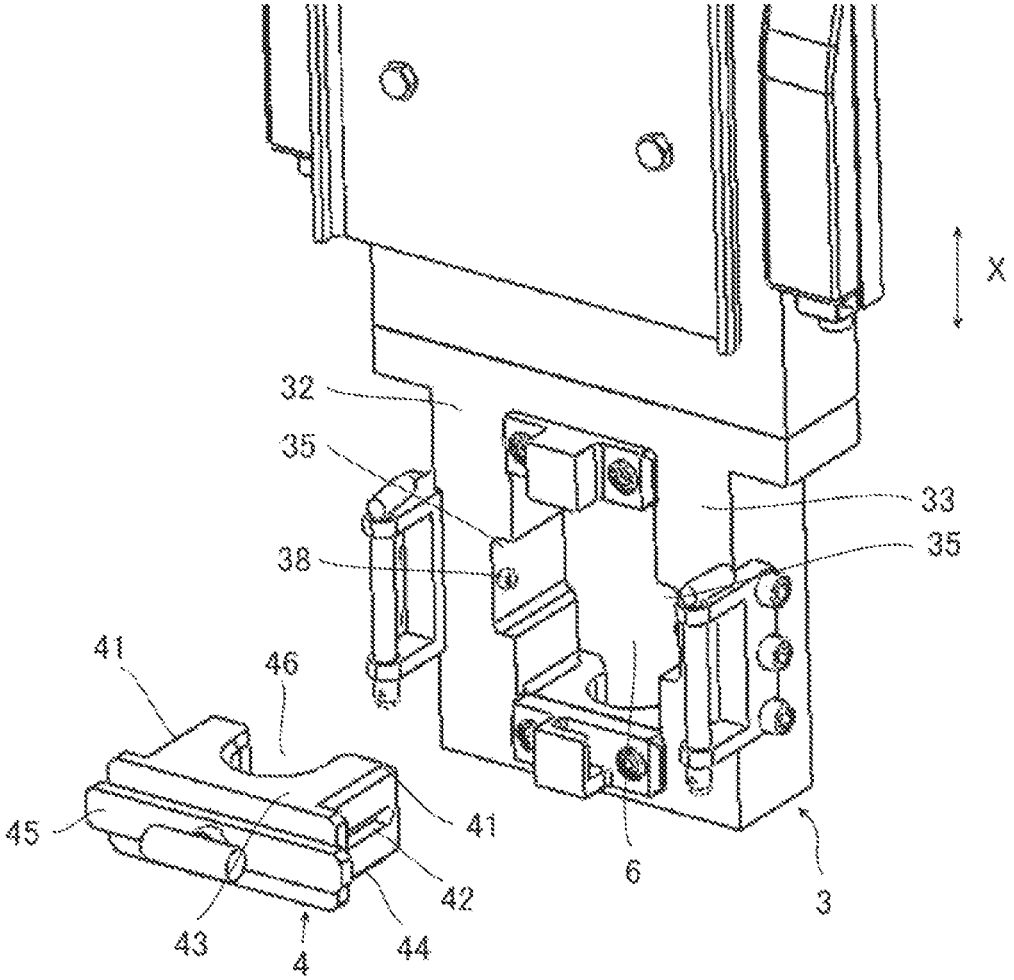
FIG. 3 is an illustration diagram depicting a separator and a coupling portion.
Figure 7:
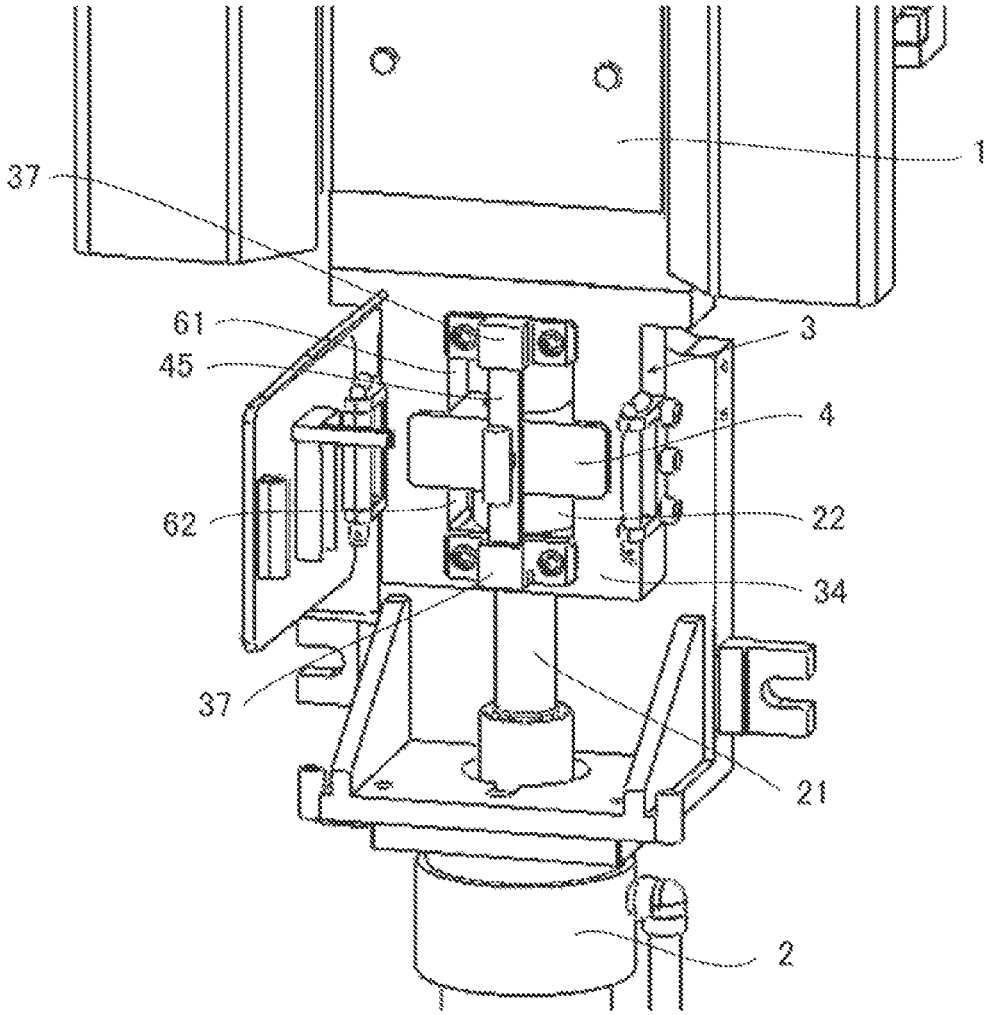
FIG. 7 depicts the coupling position switching mechanism of FIG. 1, in a state in which a separator is inserted and fixed, and the rod head is located in a second coupling chamber (a second coupling state).

FIG. 3 is an illustration diagram depicting a separator and a coupling portion, these are depicted in a separated state for illustrative purposes. The separator 4 has fitting portions 41 respectively formed on both side surfaces thereof, these fitting portions 41 are fitted into each fitting recesses 35 in two parallel frames 32, 33 of the coupling portion 3, and held by the coupling portion 3 so as to be movable in a direction perpendicular to the sliding direction X of the slide metal frame. Furthermore, each protrusion 38 provided on the respective inner surface of the fitting recesses 35 of the parallel frames 32, 33 is fitted in the grooves 42 provided on the respective side surfaces of the fitting portions 41 on both sides of the separator 4, thereby the separator 4 is held to prevent drop-out of the parallel frames 32, 33. Further, the separator 4 is provided with a U-shaped groove 46 having an opening opened in a surface located on the side of the drive rod, and the drive rod 21 is fittingly inserted into the groove 46, thereby the separator 4 can be inserted into the coupling space 6. A first contacting surface 43 and a second contacting surface 44 of the separator 4 perpendicular to the sliding direction X of the slide metal frame are configured to be contactable with the back surface and the front surface of the rod head 22 of the drive rod 21, respectively. Also a stopper 45 is rotatably provided on the back surface of the separator 4 opposite to the drive rod 21. As depicted in FIG. 7, the stopper 45 can be engaged at both ends thereof with the engaging portion 37 provided in the coupling portion 3 (the slide metal frame 1) by rotating the stopper 45.

In the above configuration, the coupling space 6 is divided into a first coupling chamber 61 and a second coupling chamber 62 by the separator 4 (FIG. 7). During a surface pressure applying/releasing operation, a first coupling state where the rod head 22 is located in a first coupling chamber 61 is established, during a casting operation, a second coupling state 62 where the rod head 22 is located in a second coupling chamber 62 is established.

That is, a first coupling state where the rod head 22 is located and coupled in the first coupling chamber 61 is a state which the surface pressure is applied/released. The rod head 22 is brought into contact with the first contacting surface 43 in the separator 4 or the base end frame 31 (the slide metal frame 1) to transmit the driving force of the drive unit, thereby to slidingly move the slide metal frame 1. On the other hand, the second coupling state where the rod head 22 is located and coupled in the second coupling chamber 62 is a state which the slide metal frame 1 has been slidingly moved while constantly applying the surface pressure for use in the casting operation. The rod head 22 is brought into contact with the second contacting surface 44 in the separator 4 or the coupling frame 34 to transmit the driving force of the drive unit, thereby to slidingly move the slide metal frame 1.

A clearance with the rod head 22 in the sliding direction X in the second coupling chamber 62 is sufficient as large as the size of the conventional coupling mechanism in which the coupling position is not switched. On the other hand, the first coupling chamber 61 is coupled to the rod head 22 only for sliding movement of the slide metal frame during the surface pressure applying/releasing operation, thus the coupling accuracy is not required. Therefore, it is possible to secure a sufficient clearance to prevent hindrance to the coupling position switching operation.

The respective fitting portions 41 on both sides of the separator 4 are fitted into the respective fitting recesses 35 of the parallel frames 32, 33 in the coupling portion 3, so that the separator 4 can provide the two coupling chambers (the first coupling chamber 61 and the second coupling chamber 62) which the rod head 22 can be fitted within the coupling space 6. Therefore, the insertion position of the separator 4 is always constant, so the operation becomes simplified and it is possible to prevent the operator from inserting the separator into the wrong position. Furthermore, the separator 4 can be held by the coupling portion 3 as in this example, thus there is no complication of removing the separator 4 from the coupling portion 3, and there is free of losing the separator 4. However, the separator 4 can be held in the coupling portion by any means other than the one of this example and may be held in an openable and closable manner by a hinge, for example, as described later as a second embodiment.

Figure 4:
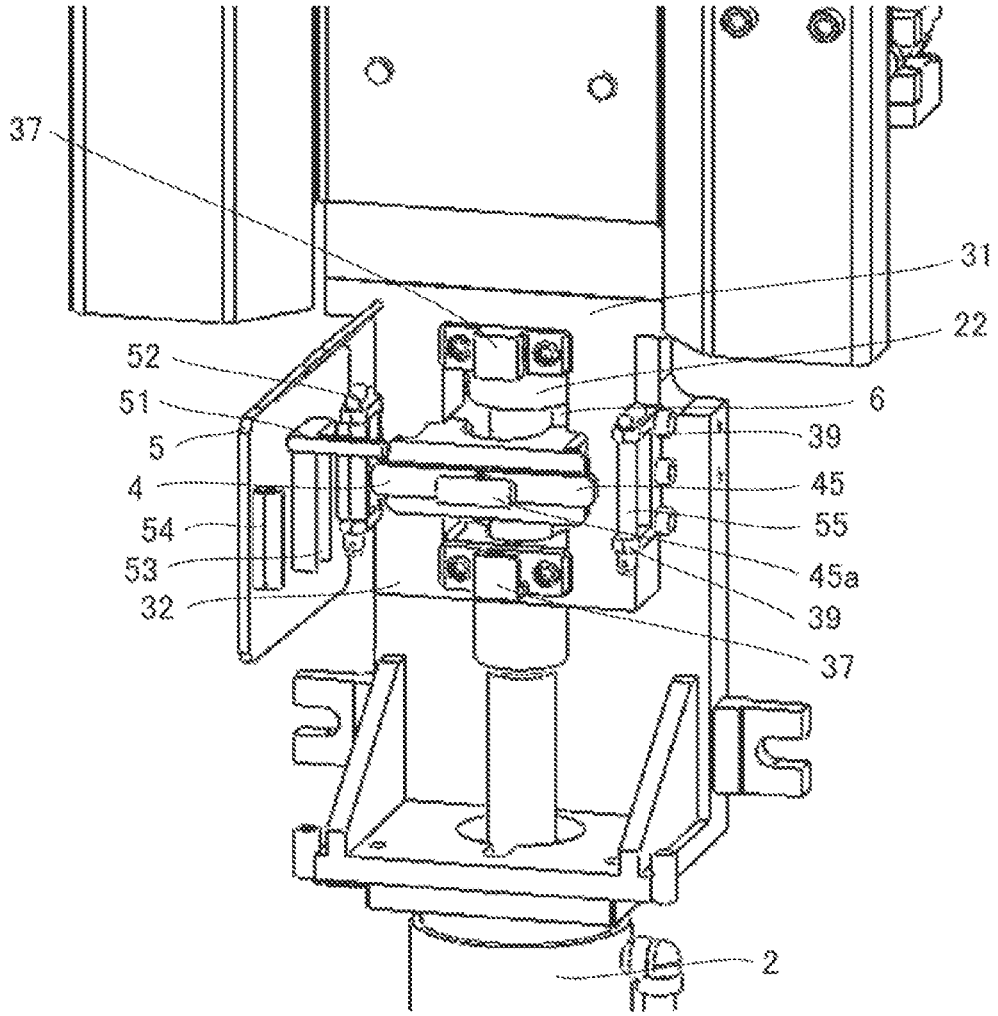
FIG. 4 depicts the coupling position switching mechanism of FIG. 1, in a state in which a rod head contacts a base end frame and the drive unit is at the forward limit position.

Moreover, the coupling portion 3 can be provided with a heat insulating cover 5 as depicted in FIG. 4. The heat insulating cover 5 is a plate-like member provided pivotably by a hinge 52 on the side surface of one parallel frame 32, and has one protrusion 51 and a fitting groove 53 on the side of the coupling space 6. When the heat insulating cover 5 is closed, this protrusion 51 is inserted into the first coupling chamber 61 in the coupling space 6. That is, in the first coupling state in which the rod head 22 is located and coupled in the first coupling chamber 61, the protrusion 51 is brought into contact with the rod head 22, thus the heat insulating cover 5 cannot be closed. In addition, when the stopper 45 of the separator 4 is not locked to the engaging portion 37 in the coupling portion 3, a handle 45*a* of the stopper 45 cannot engage with the fitting groove 53, thus the heat insulating cover 5 cannot be closed. Therefore, it is possible to prevent forgetting to lock the stopper 45. The heat insulating cover 5 can be locked by aligning the bracket 39 provided on the other parallel frame 33 with a hole of the guide 54 having a through-hole and inserting a pin 55.

Next, the procedure of surface pressure-applying/releasing operation will be described.

First, from the state in FIG. 5 in which the slide metal frame is closed and the surface pressure is released after the plate-checking/replacing operation, the procedure of the surface pressure-applying operation will be described.

Figure 5:
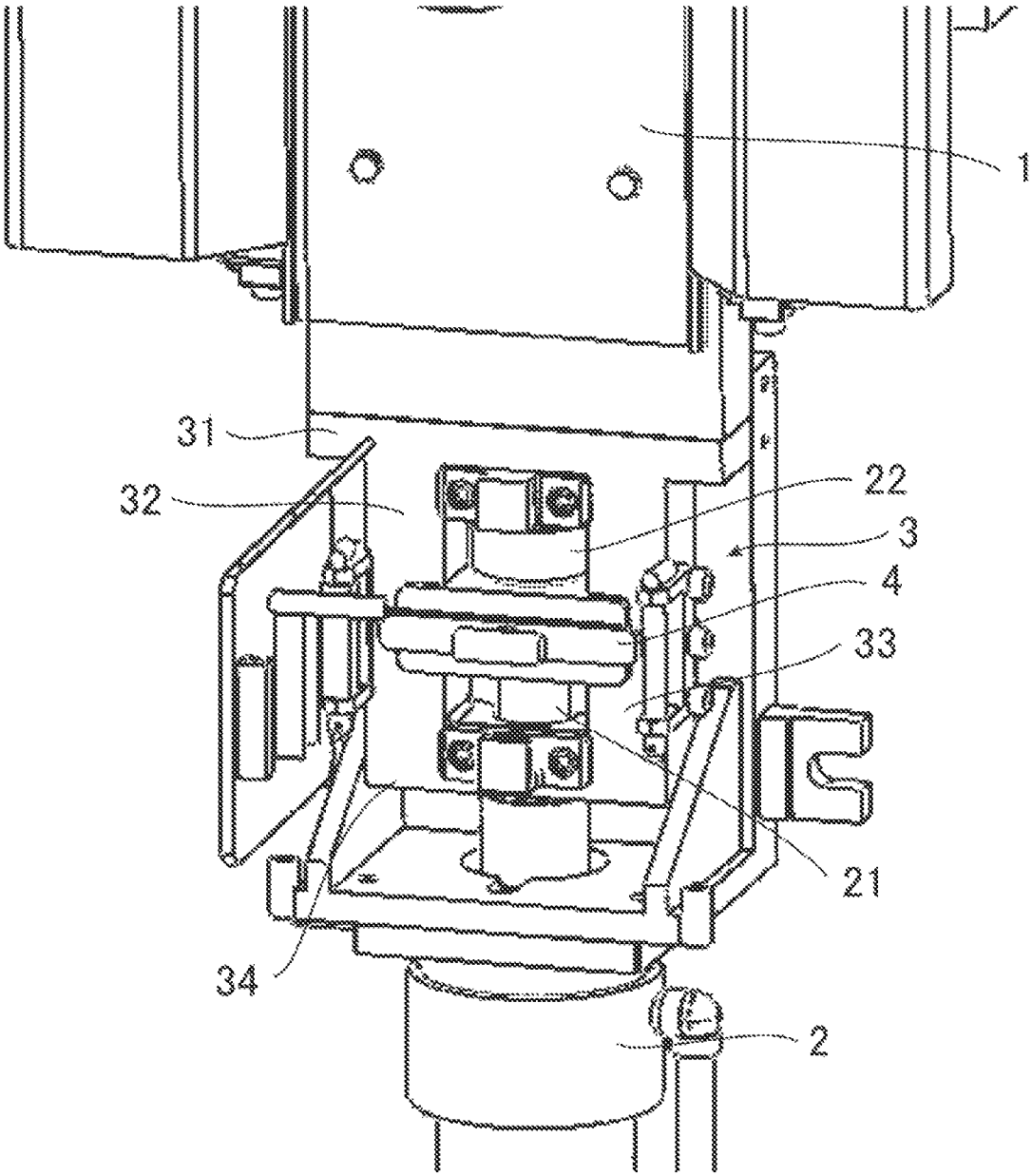
FIG. 5 depicts the coupling position switching mechanism of FIG. 1, in a state in which the slide metal frame is closed and the surface pressure is released after the plate-checking/replacing operation.

1) The state in FIG. 5 is a state which is immediately after closing the slide metal frame 1 and the drive unit 2 is at the rearward limit position. In this state, the drive unit 2 is set to the forward limit position and the slide metal frame 1 is moved to apply the surface pressure. After moving the slide metal frame 1, the separator 4 is pulled to establish the state in FIG. 4.

Figure 6:
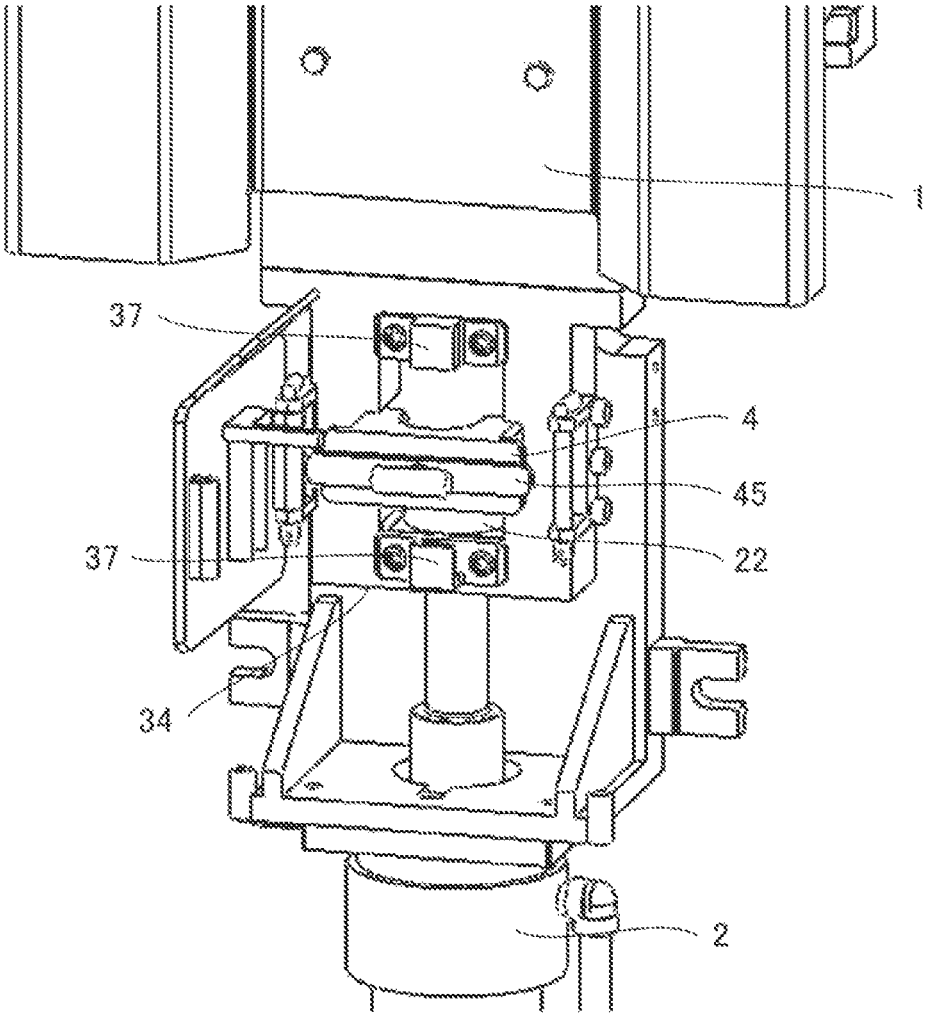
FIG. 6 depicts the coupling position switching mechanism of FIG. 1, in a state in which the rod heat contacts the coupling frame.

2) In FIG. 4, when the drive unit 2 is set to the rearward limit position, the back surface of the rod head 22 is brought into contact with the coupling frame 34 to establish the state in FIG. 6. At that time the separator 4 has pulled outwardly, thus the rod head 22 can be moved without contact with the separator 4.

3) In FIG. 6, the separator 4 is pushed toward the side of the drive rod 21, the stopper 45 is rotated clockwisely by 90 degrees to engage with the engaging portion 37, and the rod head 22 is positioned in the second coupling chamber 62 to establish the state in FIG. 7 (a second coupling state).

Figure 8:
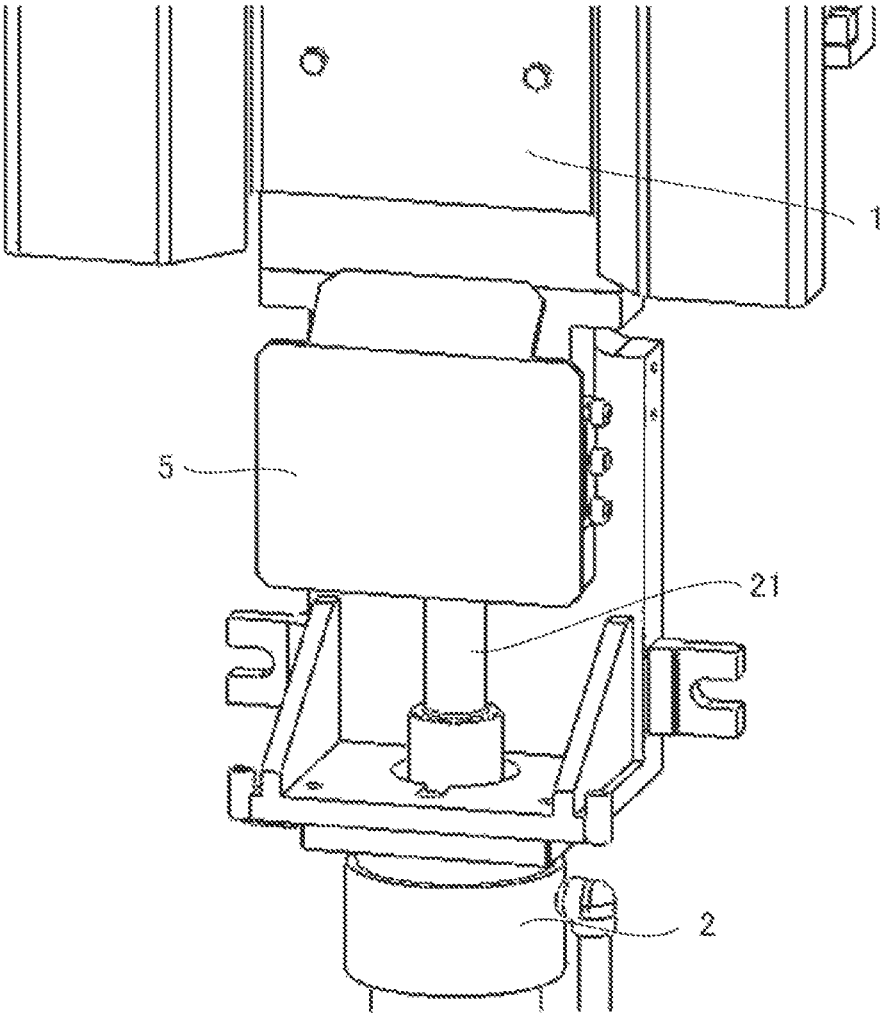
FIG. 8 depicts the coupling position switching mechanism of FIG. 1, in a state in which the rod head is located in a second coupling chamber and a heat insulating cover is closed.

4) The heat insulating cover 5 is closed to establish the state in FIG. 8.

Next, from the state in FIG. 8 in which the surface pressure is applied, the procedure of the surface pressure-releasing operation will be described.

Figure 9:
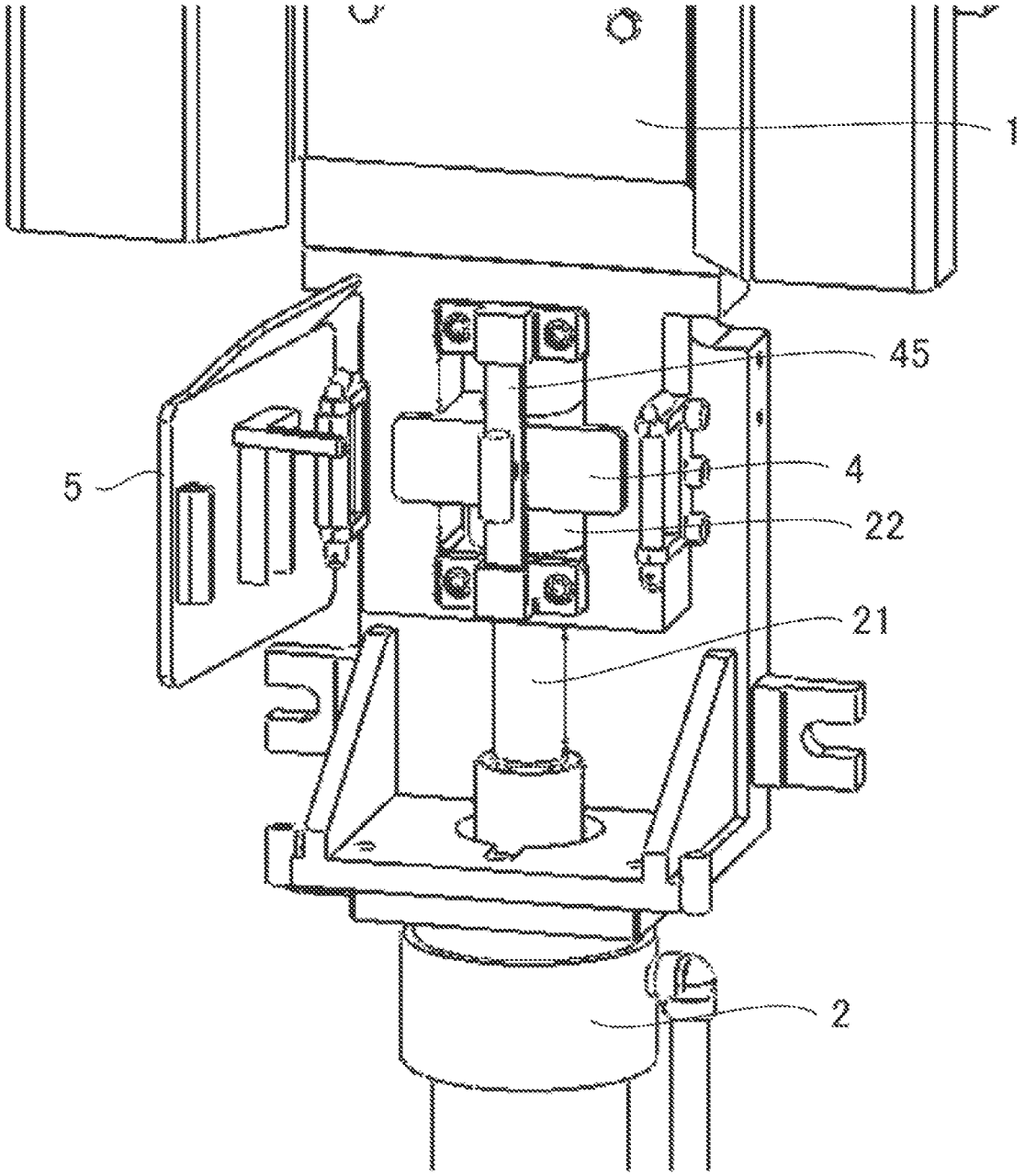
FIG. 9 depicts the coupling position switching mechanism of FIG. 1, in a state in which the rod head is located in a second coupling chamber and the heat insulating cover is opened (a second coupling state).

1) From the state in FIG. 8, the heat insulating cover 5 is opened to establish the state in FIG. 9.

Figure 10:
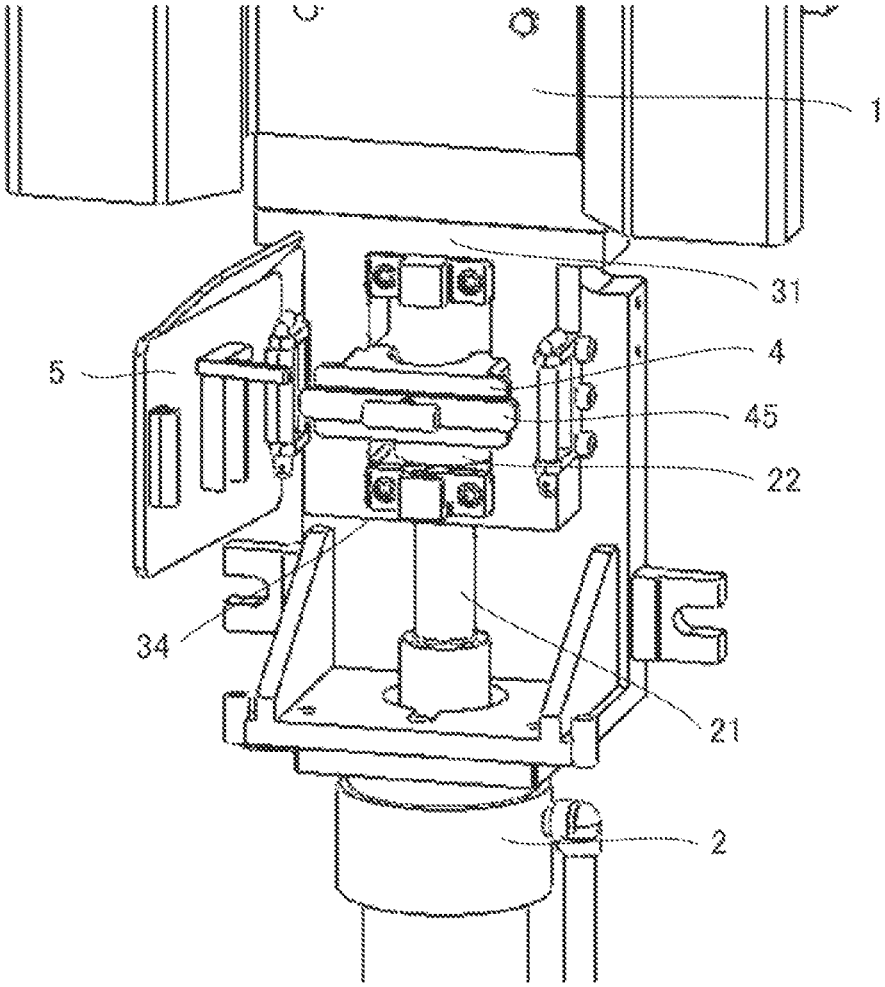
FIG. 10 depicts the coupling position switching mechanism of FIG. 1, in a state in which after unlocked, the separator is pulled outwardly from a fitting portion with the rod head being contact with the coupling frame.

2) In FIG. 9, the stopper 45 is rotated counterclockwisely by 90 degrees and then the separator 4 is drawn to establish the state in FIG. 10.

Figure 11:
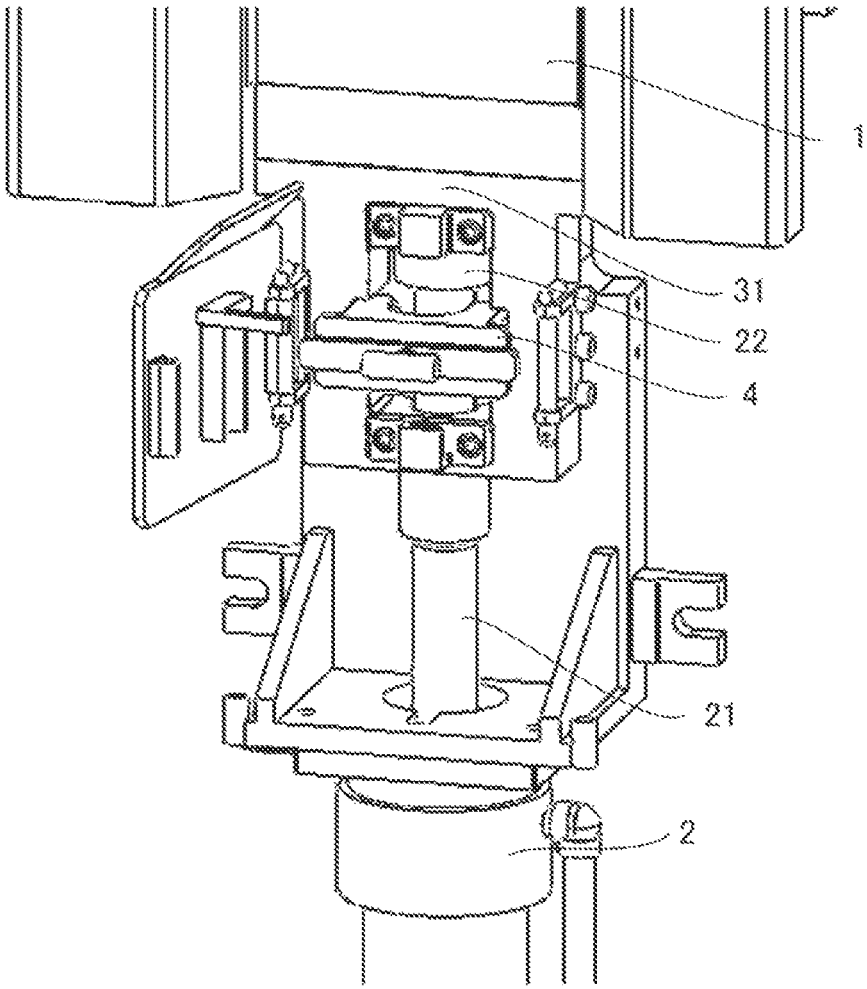
FIG. 11 depicts the coupling position switching mechanism of FIG. 1, in a state in which the rod head avoids the separator, and the separator is pulled outwardly with the rod head being contact with the base end frame.

3) The drive unit 2 is set to the forward limit position, and the rod head 22 is moved toward the side of the base end frame 31 to establish the state in FIG. 11.

Figure 12:
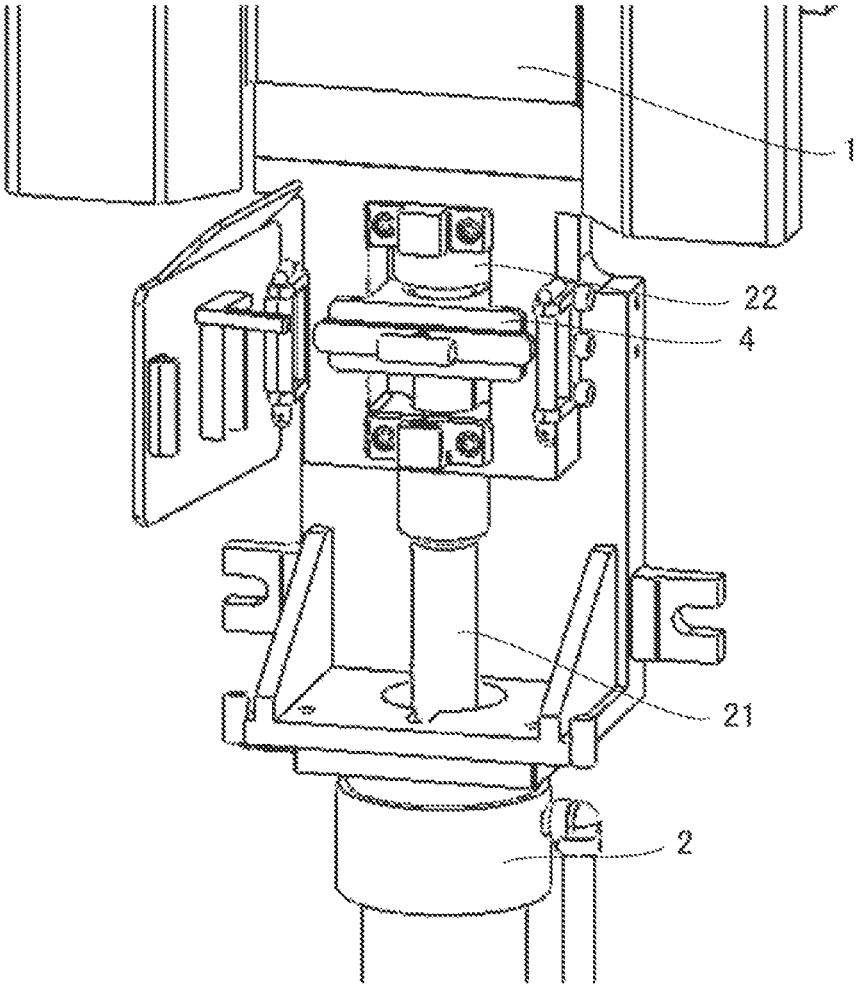
FIG. 12 depicts the coupling position switching mechanism of FIG. 1, in a state in which the separator is insert and the rod head is located in a first coupling chamber (a first coupling state).
Figure 13:
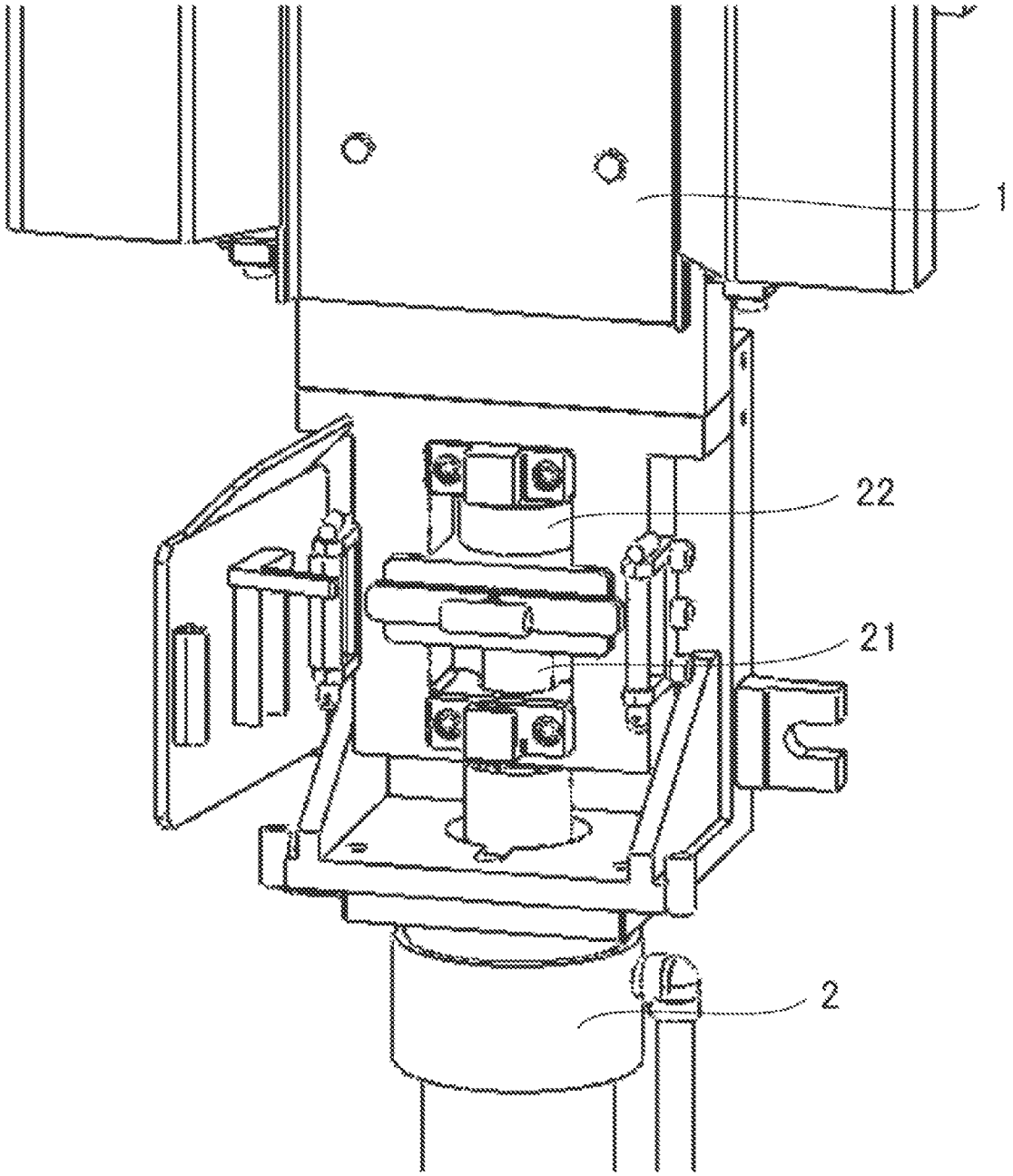
FIG. 13 depicts the coupling position switching mechanism of FIG. 1, in a state in which the rod head is located in a first coupling chamber and the drive unit is at the rearward limit position (a first coupling state).

4) In FIG. 11, the separator 4 is pushed to establish the state in FIG. 12 (the first coupling state). At that time there is no need to lock with the stopper 45.

5) The drive unit 2 is set to the rearward limit position to release the surface pressure. After releasing the surface pressure, the slide metal frame 1 can be opened.

In this manner, switching between the first coupling state of FIG. 12 and the second coupling state of FIG. 7 can be easily realized by the slidingly movement of the separator 4 within the coupling space 6 and the movement of the rod head 22. In this case, the inserting position of the separator 4 into the coupling space 6 remains always at the same position, and does not change as in the prior art. For this reason, the operation is simple and there is no problem of inserting into the wrong position.

The separator 4 is constructed to engage the fitting portions 41 at the both ends thereof with the fitting recesses 35 of the parallel frames 32, 33 so as to transmit the driving force of the drive unit from the separator 4 to the slide metal frame 1. Thus the driving force can be transmitted at a plurality of arbitrary points, so that the driving force of the drive unit can be distributed and transmitted to the coupling portion 3 of the slide metal frame 1 in a well-balanced manner. Therefore, it is possible to reliably and smoothly transmit the driving force of the drive unit to the slide metal frame.

Furthermore, in the present invention, the coupling portion 3 is provided to protrude from the slide metal frame 1, thus it is possible to eliminate a need for a guide rail and an extension guide disposed to be slidingly moved along the guide rail in an extendable manner, which would be required in Patent Document 1 in which the above-described guide piece is used as a coupling portion. In addition, the rod head 22 is attachable and detachable to the coupling portion 3 provided to protrude from the slide metal frame 1, thus it is possible to eliminate a need for an attachment/detachment mechanism with respect to the slide metal frame as in Patent Document 1. Therefore, the structure of the coupling portion 3 can be simplified and downsized, and the distance between the drive unit 2 and the slide metal frame 1 can be shortened, so that the sliding nozzle device can also be downsized.

In this example, the drive unit is located below the slide metal frame 1, thus when the slide metal frame 1 is located at a lowermost position in the sliding range, a surface pressure is released. As a result, even when the slide metal frame 1 is opened, the drive unit and the slide metal frame 1 is decoupled, it is possible to prevent the slide metal frame 1 from slidingly move downwardly due to gravity, thus providing a safety mechanism.

However, the present invention is also applicable to the case where the drive unit is located just above the slide metal frame 1 when the slide metal frame 1 is opened. In the case where the drive unit is located just above the slide metal frame 1, during surface pressure-applying/releasing operation, the rod head 22 is located in the first coupling chamber 61, while during a casting operation, the rod head 22 is located in the second coupling chamber 62. It should be noted that with reference to the floor surface, the farther from the floor surface is the first coupling chamber, and the closer to the floor surface is the second coupling chamber.

A Second Example

Figure 14A:
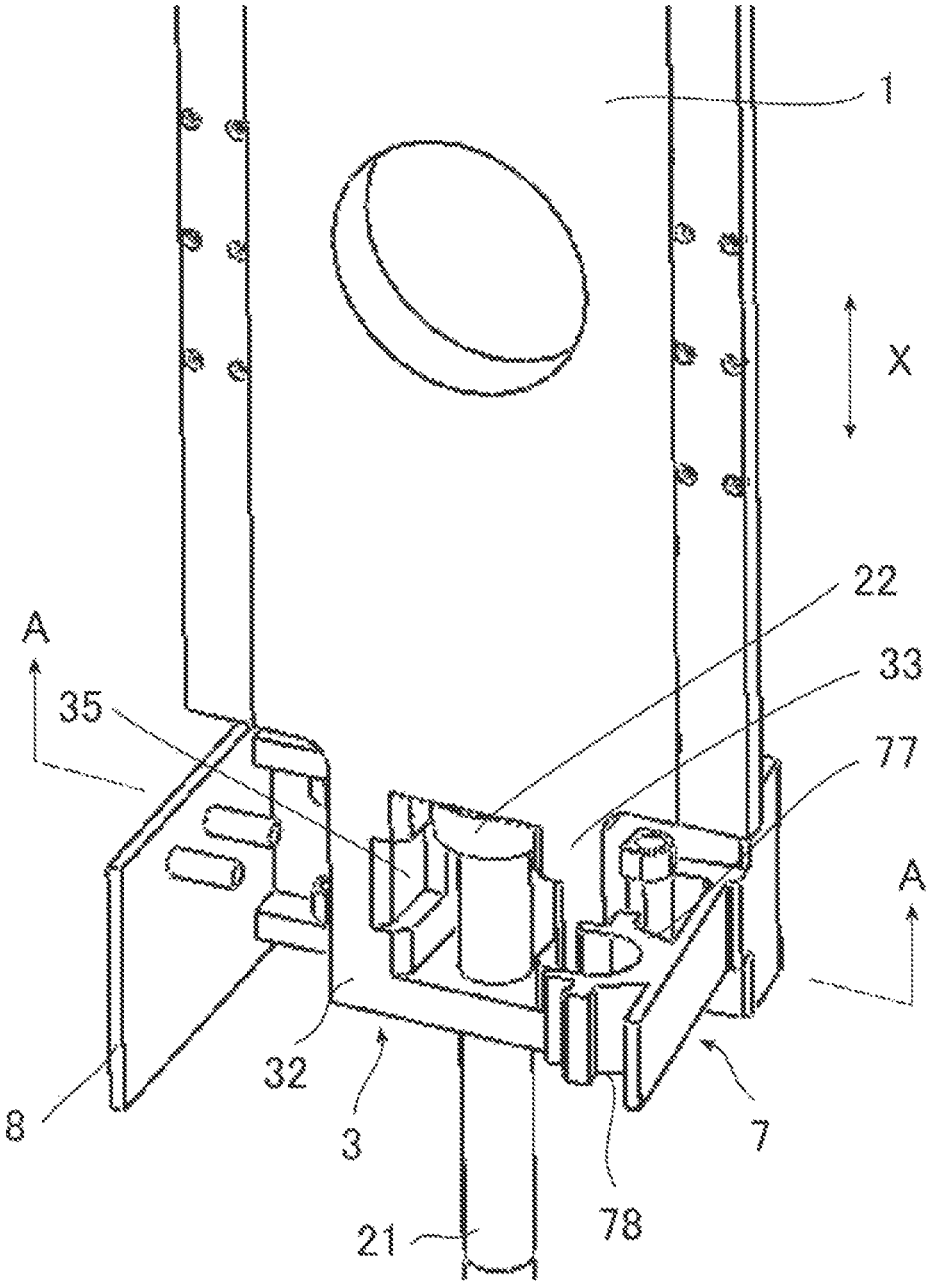
FIG. 14A is a perspective view depicting a substantial part of a slide metal frame-drive unit coupling position switching mechanism according to another example (a second example) of the present invention, in a state which the separator is opened.
Figure 14B:
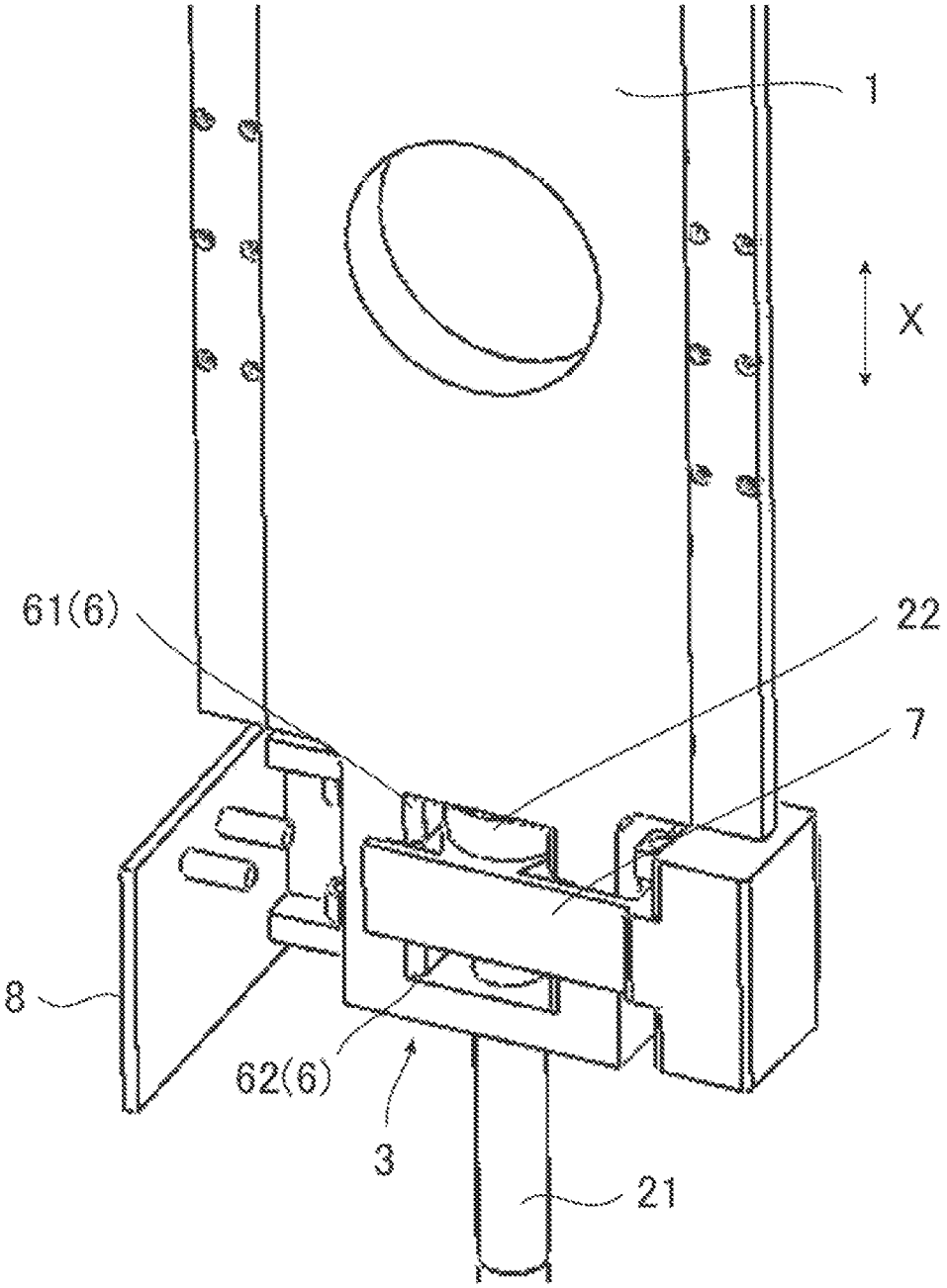
FIG. 14B is a perspective view depicting a substantial part of a slide metal frame-drive unit coupling position switching mechanism according to another example (a second example) of the present invention, in a state which the separator is closed.
Figure 15:
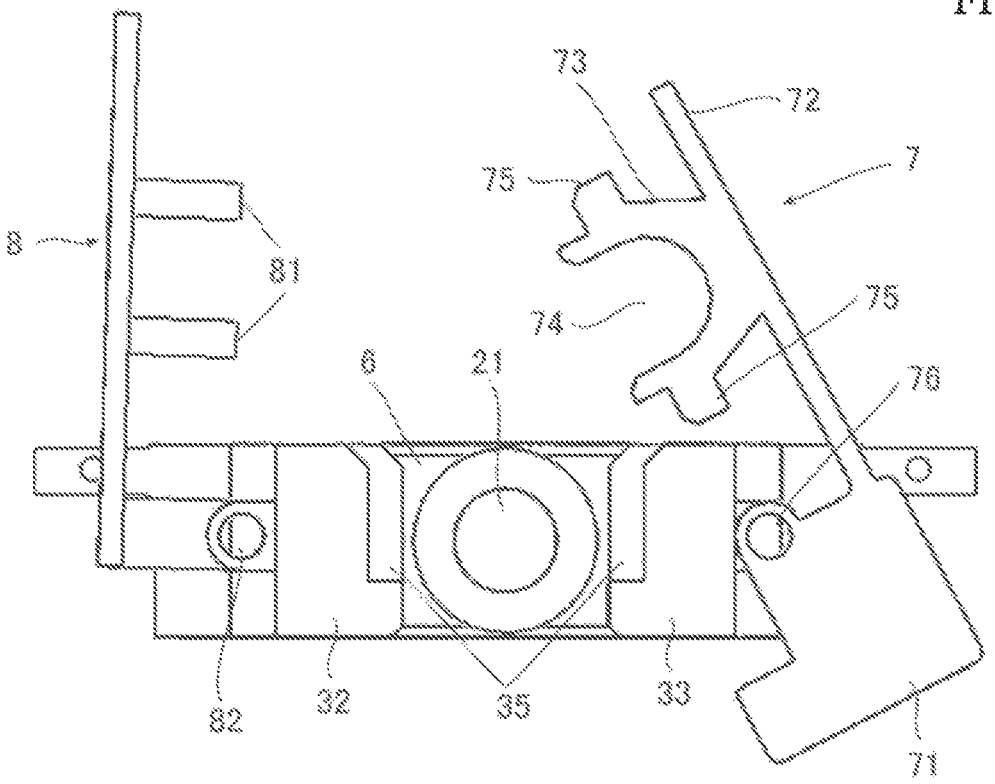
FIG. 15 depicts A-A section of FIG. 14A.
Figure 16:
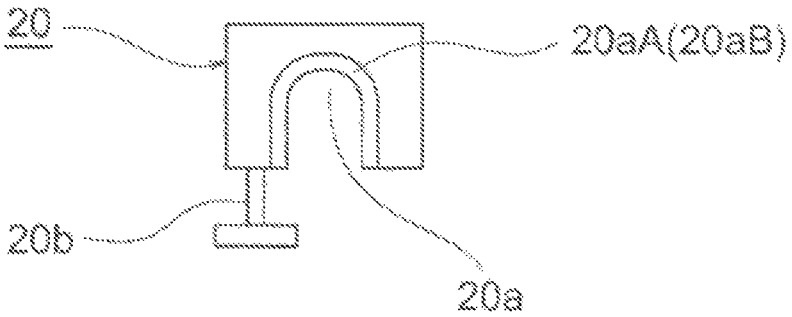
FIG. 16 is a perspective view depicting a coupling position switching means in a conventional coupling position switching mechanism.
Figure 17:
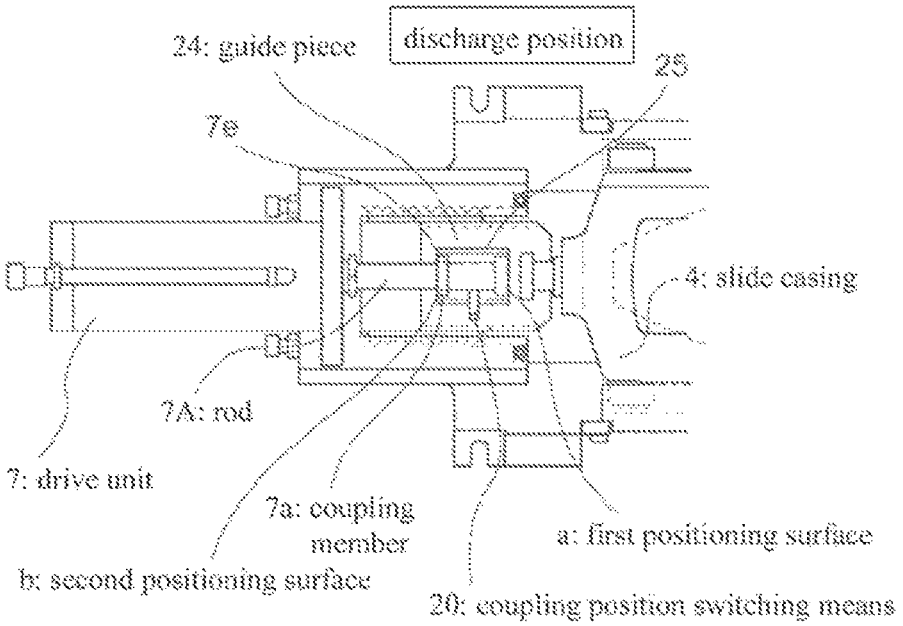
(PRIOR ART) FIG. 17
FIG. 17 is a plan view depicting the conventional coupling position switching mechanism.
Figure 18:
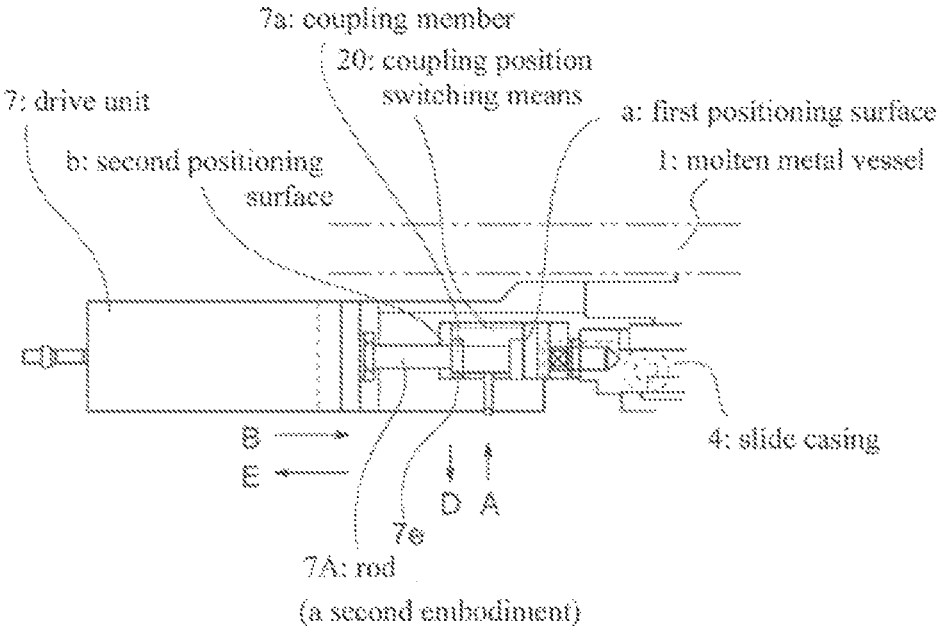
FIG. 18 is a cross-sectional view depicting the conventional coupling position switching mechanism.

FIGS. 14A and 14B are perspective views depicting a substantial part of a slide metal frame-drive unit coupling position switching mechanism according to another example (a second example) of the present invention, FIG. 14A depicts a state which the separator is opened, FIG. 14B depicts a state which the separator is closed. FIG. 15 depicts an A-A section of FIG. 14A.

This example is different from the previous example (the first example) in the configuration of the separator. Other components of this example are substantially identical to those of the previous example. Thus in FIGS. 14A, 14B, and 15, the same reference numerals are given to the components corresponding to those of the previous examples, and the descriptions thereof will be omitted.

In this example, a separator 7 is pivotably provided on the side surface of one parallel frame 32. As depicted in FIG. 15, the separator 7 has a counterweight 71, an open-close plate 72 extending from the counterweight 71, and an inserting portion 73 provided on the open-close plate 72, and is pivotably coupled to the side surface of the one parallel frame 32 of the coupling portion 3 by a hinge 76. The inserting portion 73 of the separator 7 has a groove 74 having a U-shaped cross-section, and fitting raised portions 75 are provided to protrude on the both side surfaces of the inserting portion 73. When the inserting portion 73 is inserted into the coupling space 6, the groove 74 is engaged with the drive rod 21, the respective fitting raised portions 75 are fitted into the fitting recesses 35 provided in the respective parallel frames 32, 33. Further, both end faces of the inserting portion 73 on the side of the sliding direction X have a first end face 77 and a second end face 78, which are contactable surfaces with the rod head 22 (see FIG. 14A).

Moreover, the coupling portion 3 can be provided with a heat insulating cover 8. The heat insulating cover 8 is a plate-like member provided pivotably by a hinge 82 on the side surface of one parallel frame 32, and has two protrusions 81 on the side of the coupling space. When the heat insulating cover 8 is closed, this protrusions 81 are inserted into the first coupling chamber 61 in the coupling space 6. That is, in the first coupling state in which the rod head 22 is located and coupled in the first coupling chamber 61, the protrusion is brought into contact with the rod head 22, thus the heat insulating cover 8 cannot be closed.

LIST OF REFERENCE SIGNS

1: slide metal frame
2: drive unit
21: drive rod
22: rod head
3: coupling portion
31: base end frame
32, 33: parallel frame
34: coupling frame
35: fitting recess (fitting portion)
36: rod groove
37: engaging portion
38: protrusion
39: bracket
4: separator
41: fitting portion
42: groove
43: first contacting surface
44: second contacting surface
45: stopper
45*a*: handle
46: groove
5: heat insulating cover
51: protrusion
52: hinge
53: fitting groove
54: guide
55: pin
6: coupling space
61: first coupling chamber
62: second coupling chamber
7: separator
71: counterweight
72: open-close plate
73: inserting portion
74: groove
75: fitting raised portion
76: hinge
77: first end face
78: second end face
8: heat insulating cover
81: protrusion
82: hinge

The invention claimed is:

1. A slide metal frame-drive unit coupling position switching mechanism for use in a sliding nozzle apparatus configured such that a slide metal frame is slidingly moved by driving of a drive unit, to thereby selectively apply and release a surface pressure in the sliding nozzle apparatus, comprising:

a coupling portion provided in the slide metal frame to protrude at a position on the side of the drive unit and configured to allow a rod head of the drive unit to be coupled thereto, the coupling portion having a coupling space defined to allow the rod head to be disposed movably in a sliding direction of the slide metal frame and detachably; and a separator capable of being selectively inserted into and pulled out of the coupling space, the separator being configured to, upon being inserted into the coupling space, divide the coupling space into a first coupling chamber located on the side of the slide metal frame with respect to the separator, and a second coupling chamber located on the side of the drive unit with respect to the separator, in the sliding direction of the slide metal frame, wherein the rod head is configured to be switchable between a first coupling state in which the rod head is located in the first coupling chamber, such that a back surface of the rod head can be brought into contact with one of opposite surfaces of the separator facing the slide metal frame, and a second coupling state in which the rod head is located in the second coupling chamber, such that a front surface of the rod head which faces away from the back surface can be brought into contact with the other surface of the separator facing the drive unit, through operation of: pulling out the separator from the coupling space; moving the rod head in the sliding direction of the slide metal frame; and re-inserting the separator into the coupling space, and wherein the coupling portion has a fitting section for allowing the separator to be fitted thereinto when the separator is inserted into the coupling space.

2. The slide metal frame-drive unit coupling position switching mechanism as recited in claim 1, wherein the fitting section of the coupling portion comprises two fitting recesses symmetrical with respect to a longitudinal central axis of the driving rod to be inserted into the coupling space, and wherein the separator has two fittable portions fittable, respectively, into the fitting recesses.

3. The slide metal frame-drive unit coupling position switching mechanism as recited in claim 2, which further comprises a heat insulating cover attached to the coupling portion in an openable and closable manner, the heat insulating cover having a protrusion on the side of the coupling space wherein the heat insulating cover is configured such that, when the heat insulating cover is closed, the protrusion is inserted into the first coupling chamber or the second coupling chamber of the coupling space.

4. The slide metal frame-drive unit coupling position switching mechanism as recited in claim 1, which further comprises a heat insulating cover attached to the coupling portion in an openable and closable manner, the heat insulating cover having a protrusion on the side of the coupling space wherein the heat insulating cover is configured such that, when the heat insulating cover is closed, the protrusion is inserted into the first coupling chamber or the second coupling chamber of the coupling space.

5. A slide metal frame-drive unit coupling position switching mechanism for use in a sliding nozzle apparatus configured such that a slide metal frame is slidingly moved by driving of a drive unit, to thereby selectively apply and release a surface pressure in the sliding nozzle apparatus, comprising:

a coupling portion provided in the slide metal frame to protrude at a position on the side of the drive unit and configured to allow a rod head of the drive unit to be coupled thereto, the coupling portion having a coupling space defined to allow the rod head to be disposed movably in a sliding direction of the slide metal frame and detachably; and a separator configured to be inserted into the coupling space to thereby divide the coupling space into a first coupling chamber and a second coupling chamber in the sliding direction of the slide metal frame, wherein the coupling portion has a fitting section for allowing the separator to be fitted thereinto when it is inserted into the coupling space, wherein the slide metal frame-drive unit coupling position switching mechanism is configured such that a first coupling state in which the rod head is coupled in the first coupling chamber and a second coupling state in which the rod head is coupled in the second coupling chamber are switched according to insertion and pull-out of the separator with respect to the coupling space and movement of the rod head, and wherein the slide metal frame-drive unit coupling position switching mechanism further comprises a heat insulating cover attached to the coupling portion in an openable and closable manner, the heat insulating cover having a protrusion on the side of the coupling space wherein the heat insulating cover is configured such that, when the heat insulating cover is closed, the protrusion is inserted into the first coupling chamber or the second coupling chamber of the coupling space.

6. The slide metal frame-drive unit coupling position switching mechanism as recited in claim 5, wherein the fitting section of the coupling portion comprises two fitting recesses symmetrical with respect to a longitudinal central axis of the driving rod to be inserted into the coupling space, and wherein the separator has two fittable portions fittable, respectively, into the fitting recesses.

* * * * *